US008821699B2

(12) United States Patent
Nisco et al.

(10) Patent No.: US 8,821,699 B2
(45) Date of Patent: Sep. 2, 2014

(54) CONTINUOUS ELECTROLYTIC SURFACE FINISHING OF BARS

(75) Inventors: Nicola Nisco, Milan (IT); Ilaria Muratori, Milan (IT)

(73) Assignee: Plating Innovation s.r.l., Settimo Milanese (IT)

( * ) Notice: Subject to any disclaimer, the term of this patent is extended or adjusted under 35 U.S.C. 154(b) by 492 days.

(21) Appl. No.: 13/266,309

(22) PCT Filed: Apr. 30, 2010

(86) PCT No.: PCT/EP2010/055918

§ 371 (c)(1),
(2), (4) Date: Jan. 17, 2012

(87) PCT Pub. No.: WO2010/128000

PCT Pub. Date: Nov. 11, 2010

(65) Prior Publication Data

US 2012/0111729 A1 May 10, 2012

(30) Foreign Application Priority Data

May 5, 2009 (IT) ..... MI09A0760

(51) Int. Cl.
*C25D 7/00* (2006.01)
*C25D 17/00* (2006.01)

(52) U.S. Cl.
CPC ..... *C25D 7/00* (2013.01); *C25D 17/005* (2013.01)
USPC ..... 204/198; 204/202; 205/137; 205/138; 205/151

(58) Field of Classification Search
CPC ..... C25D 7/00; C25D 7/005; C25D 7/007
USPC ..... 204/198, 202; 205/137, 138, 151
See application file for complete search history.

(56) References Cited

U.S. PATENT DOCUMENTS 4,132,618 A * 1/1979 Boulanger et al. ..... 204/218
5,865,979 A 2/1999 Collins, Jr.
2007/0278093 A1 12/2007 Barnard

FOREIGN PATENT DOCUMENTS

JP 02-061093 3/1990

* cited by examiner

*Primary Examiner* — Nicholas A Smith
(74) *Attorney, Agent, or Firm* — Jacobson Holman, PLLC.

(57) ABSTRACT

An apparatus (1) for continuous electrolytic surface finishing of bars (2) is described, comprising at least one cathode (3), one electrolytic cell (4) containing an electrolyte (5) and comprising an inlet (6) and an outlet (7) for the bars (2), and at least one longitudinal anode (8) along the route of the bars (2) inside the electrolytic cell (4), and means (9) for feeding the bars (2) along the axis of the bars (2) for introducing the bars (2) into the cell (4). Said at least one cathode (3) consists of a plurality of sliding contacts (11), each of which is provided with a selectively and independently actuatable energetic source (30) thereof.

5 Claims, 5 Drawing Sheets

CONTINUOUS ELECTROLYTIC SURFACE FINISHING OF BARS

This is a national stage of PCT/EP10/055918 filed Apr. 30, 2010 and published in English, which claims the priority of Italian number MI2009A000760 filed May 5, 2009, hereby incorporated by reference.

The present invention relates to a process and apparatus for continuous electrolytic surface finishing of bars.

A first continuous chrome-plating system is known, which includes a sequence of bars, connected to one another by means of a threaded pin in order to ensure mechanical and electric continuity thereof, which bars run (without revolving on themselves) on rollers by virtue of a tractor roller through an electrolytic cell where the surface deposit procedure is carried out. The electric contact to the bar is alternatively supplied:

- by passing the bars through a tank containing mercury, the latter connected to the negative pole of a current rectifier; said mercury contacts are located at the two ends of the electrolytic cell, which has one or more anodes connected to the positive pole therein, the solution closes the circuit; this method is complex, highly dangerous due to mercury toxicity, and does not allow large amounts of current to be transferred, because mercury is not a good conductor and therefore causes high voltage drops; the passage of current causes a considerable heating of the mercury, which should be cooled by appropriate systems;
- by means of a contact between the bar and a metal conductor in the form of a flexible braid which is wound about the bar on one side and about a revolving drum on the other side, the drum being made of conducting material connected to the negative pole. This apparatus is mechanically very complicated and does not work correctly. The passage of current, indeed, causes surface alterations of the bar, with consequent production of a high number of rejects. Furthermore, this method does not allow to transfer high amounts of current.

A further method is known, which includes a sequence of bars simply queued after one another without being in reciprocal contact, which transit through an electrolytic cell, in which the machining process is carried out. These bars are fed on rollers while being rotated on their longitudinal axis by means of complex mechanical apparatuses which we may describe as revolving clamps. Said clamps have parts which come in contact with the bars made of conductive material (copper) and, in addition to mechanical contact needed for drawing, also ensure the electric contact needed for the electrolytic process. This system is very efficient and high amounts of current are transferred. However, it is mechanically very complex and requires costly maintenance operations because the contacts are to be frequently cleaned and the flexible conductors which carry the current to the clamps are to be very frequently replaced. Another disadvantage is that said clamps are translated forward by means of an actuator, which pushes them on slides. The direct consequence of this limited stroke is the need to interrupt the delivery of current and the electrolytic treatment every time the clamps reach the stoke end to allow the clamps to go back to the initial position and resume the operation. Another limiting feature is the low number of revolutions per linear meter of feeding (about half a revolution per meter). Because the amount and uniformity of the surface deposit depends on the number of revolutions which occur in the cell, this system is better than the previous one but also has many limits.

It is the object of the present invention to provide an apparatus for the continuous electrolytic surface finishing of bars which ensures very high finishing quality, use flexibility and constructional simplicity.

In accordance with the invention, this object is achieved by an apparatus for continuous electrolytic surface finishing of bars comprising at least one cathode, one electrolytic cell containing an electrolyte and comprising an inlet and an outlet for the bars, and at least one longitudinal anode along the route of the bars inside the electrolytic cell, and means for feeding the bars along the axis of the bars for introducing the bars into the cell, characterized in that said at least one cathode consists of a plurality of sliding contacts, each of which is provided with a selectively and independently actuatable energetic source (30) thereof.

These and other features of the present invention will be further explained in the following detailed description of a practical embodiment thereof, shown by the way of non-limitative example in the accompanying drawings, in which.

Figure 1:
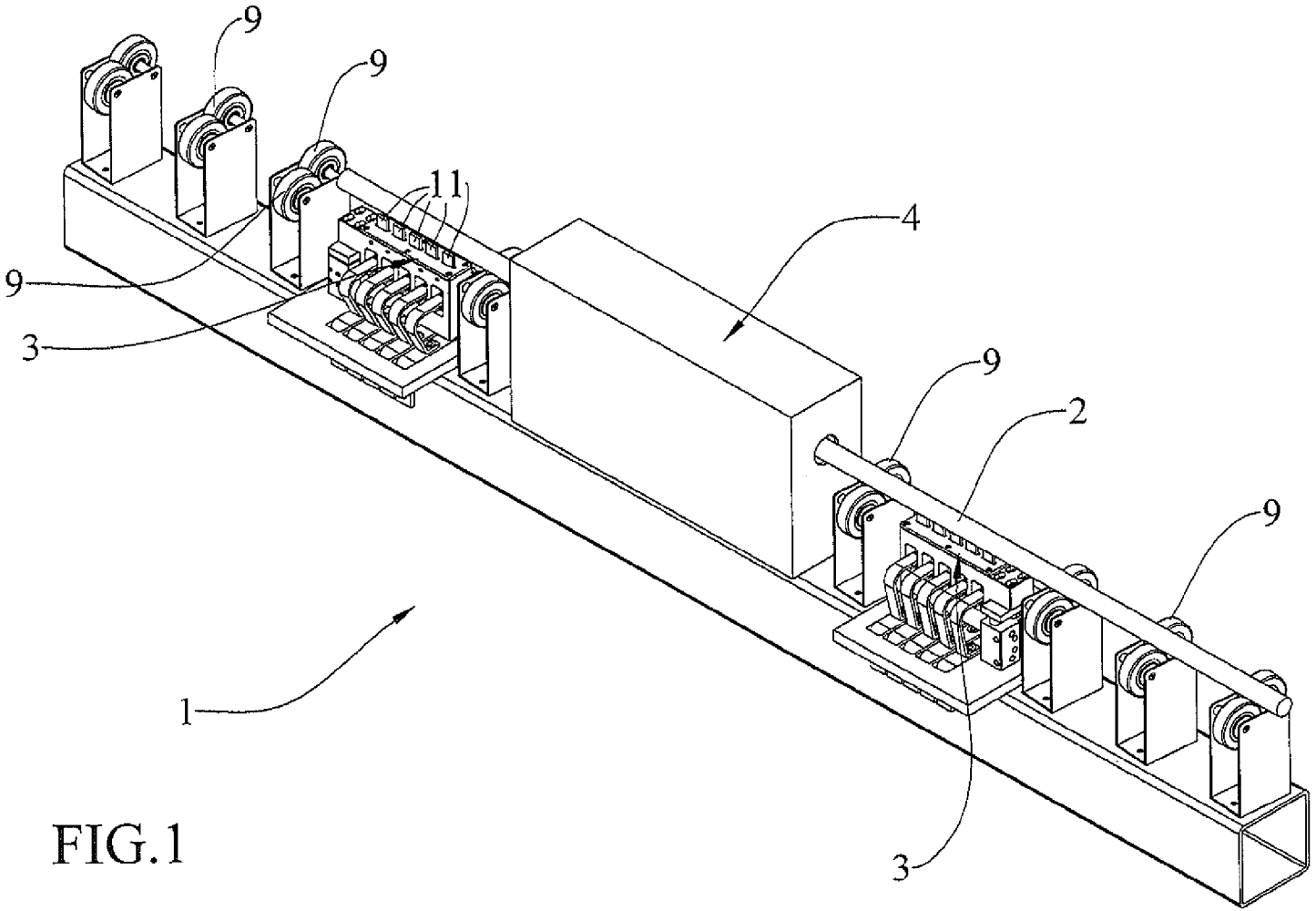
FIG. 1 shows a perspective view of an apparatus according to the invention.
Figure 2:
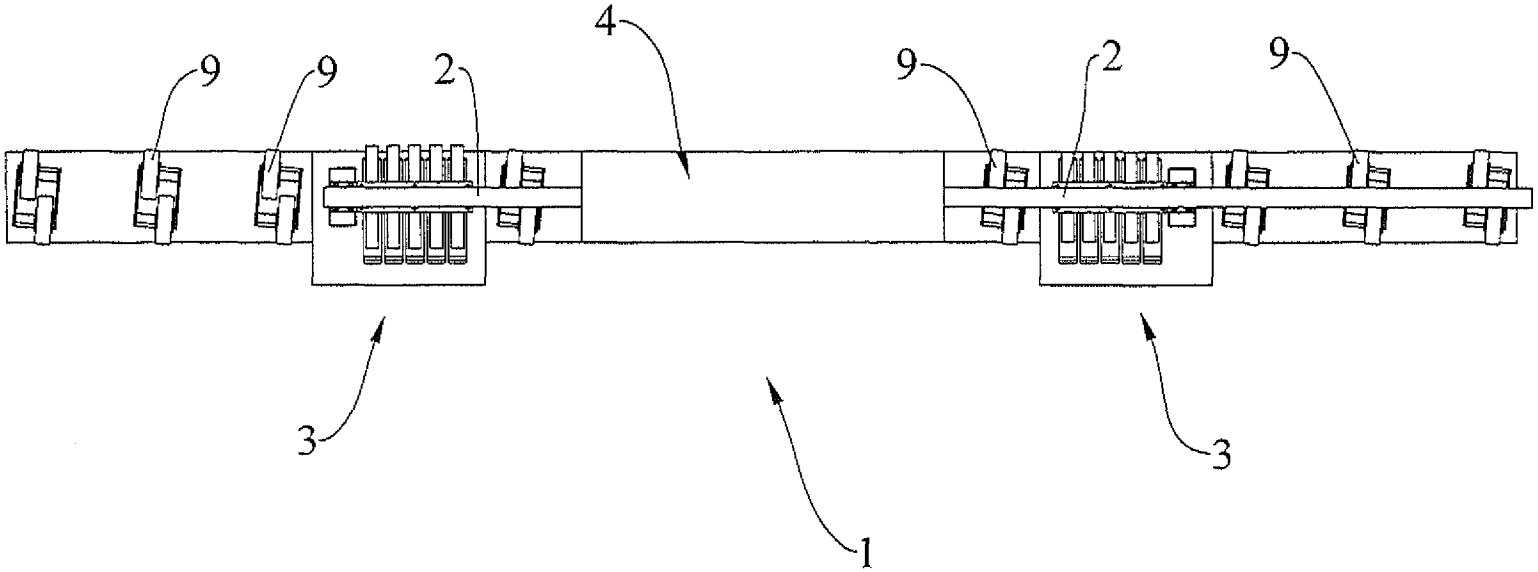
FIG. 2 is a top plan view of the apparatus.

With reference to the accompanying drawings, and in particular to FIGS. 1 and 2, an apparatus 1 for continuous electrolytic surface finishing of bars 2 (more generally of metal, non-metal or polymer objects, with full circular section and other, of any length) is shown, comprising two cathodes 3 connectable to the bar 2 to connect it either to the negative or to the positive pole depending on the treatment to be carried out, an electrolytic cell 4 containing an electrolyte 5 and comprising an inlet 6 and an outlet 7 for the bars 2; a longitudinal anode 8 arranged along the route of the bars 2 within the electrolytic cell 4; a plurality of pairs of rollers 9 with inclined rotation axis, motorized or not, are used for rototranslating the bars 2 with a translation along the axis of the bars 2 for introducing the bars 2 into the cell 4 and rotating the bars 2 about their axis.

Figure 3:
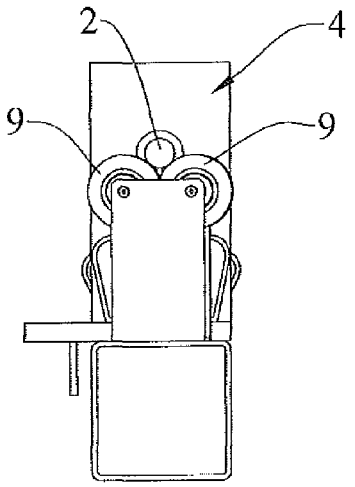
FIG. 3 is a front view of the apparatus.

The inclination of the rollers 9 is easily understandable by observing FIGS. 2 and 3: the axes of the rollers 9 belong to a horizontal plane parallel to the feeding direction of bar 2, and are inclined with respect to said feeding direction coinciding with the rotation axis of bar 2. At least one of rollers 9 works as a tractor. Within the electrolytic cell, the number of revolutions per meter is extremely high. As a result, the electrolytic treatment about the circumference of the bar is very uniform because the phenomenon of current density non-uniformity on the cathode surface due to the distance between anode and cathode, to the geometries thereof and to the presence of gases developed by the electrochemical process is cancelled. Furthermore, this system allows to use an anode 8 with an extremely simplified shape as compared to known solutions.

The electrolytic cell 4 further comprises nozzles 10 for introducing a fresh electrolyte 5 in the direction of the axis of bar 2, and in both directions with respect to motion, at cell 4. This promotes a better surface finishing of bar 2, because of the better distribution of fresh electrolyte 5 and because of the effective removal of gases which are developed at the anode and the cathode during the process.

Said nozzles 10 are advantageously toroidal and arranged about bar 2.

Figure 4:
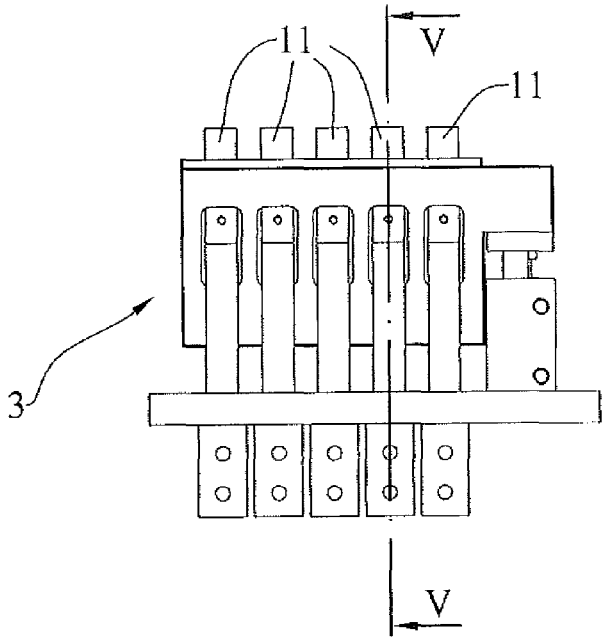
FIG. 4 is a side view of the sliding electric contacts.
Figure 5:
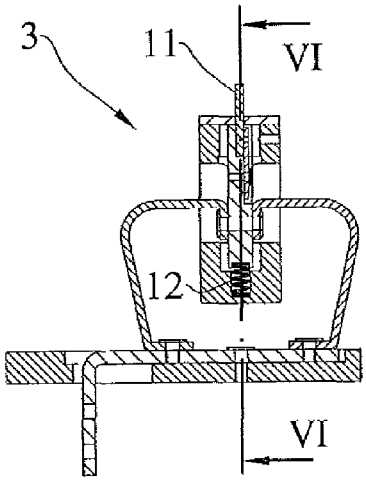
FIG. 5 shows a section view taken along line V-V in FIG. 4.
Figure 6:
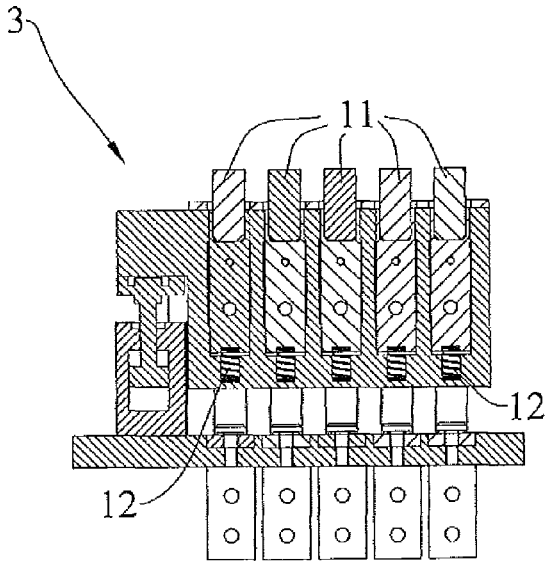
FIG. 6 shows a section view taken along line VI-VI in FIG. 5.
Figure 7:
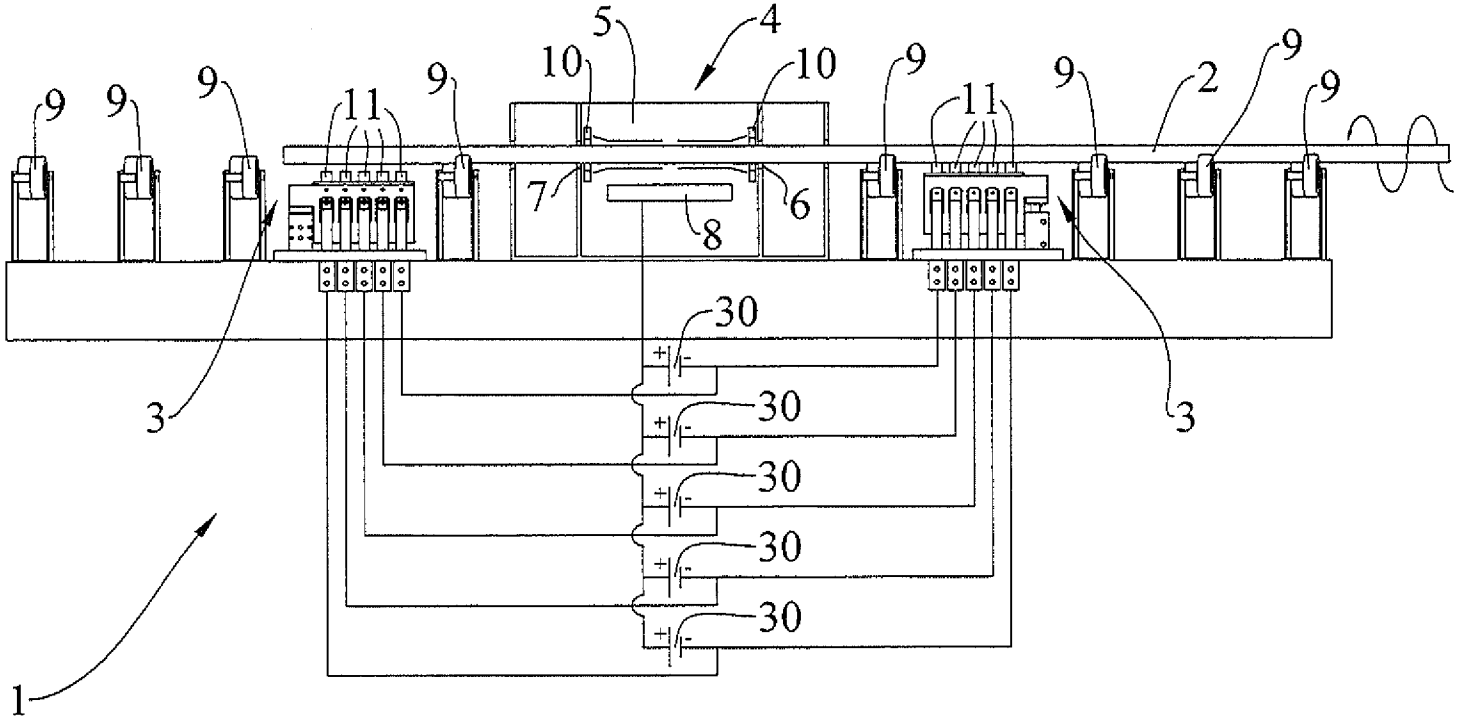
FIG. 7 shows a diagrammatic cross-section view of an embodiment with sliding contacts according to the invention.

The cathodes 3, one upstream and the other downstream of the cell 4, each comprise a plurality of sliding contacts 11 on the bar 2 (FIGS. 4-6) independently supplied from one another, i.e. each contact has an independent energy source 30 (FIG. 7).

Said contacts 11 are selectively actuatable and electrically adjustable independently from one another, in order to select the current level passing in cell 4.

In particular, the contacts 11 are of said sliding type and are one or more prism-shaped electric contacts 11 made of conductive materials accommodated in containers and moved by actuators which put them in contact with or detach them from the bar. In contact with the bar 2, they transfer the electric charge to bar 2. In order to fully exploit potentialities, each single contact 11 is connected to a source of electricity 30 which is sufficient to cover its maximum capacity. The maximum amount of energy delivered by the cell 4 may be increased by increasing the number of contacts 11 connected to their energy sources (FIG. 7 diagrammatically shows the sliding contacts 11 having five-contact). Adherence of the single contacts to the bar is ensured by using contact-pushing springs 12 which are adapted to the possible geometric imperfections of the bars 2.

Contacts 11 are multiple to ensure the passage of high amounts of current, because they also have a capacity limit which may be estimated as ~720 A/contact.

Furthermore, each contact 11 is individually supplied because if all contacts were supplied by the same generator, the current would tend to flow onto the contact closest to the tank, thus overloading it and therefore producing surface alterations on the part to be treated with consequent production of rejects, while the remaining contacts would be underused. On the other hand, the present invention allows to individually use each contact at its maximum limit.

The maximum current transfer threshold is no longer defined by the contacts but it only depends on the physical features of the object to be electrolyte-treated, which is impossible in the prior art. High or low amounts of amperes may be thus transmitted by varying the number of contacts and accordingly the number of installed current rectifiers.

Further advantages of the present invention include:

current delivery is interrupted only once while machining the bar unlike the known methods;

the moving parts are very small and movements are very limited and therefore enormous advantages are obtained in terms of cost for maintenance and replacing worn parts (sliding contacts only);

the amount of deposit is considerably higher if the radial thickness is uniform;

by virtue of the use of said toroidal nozzles 10 within the electrolytic tank, the hydrogen generated when machining is effectively removed from the bar surface, with consequent improvement of the structural deposit qualities, which deposit is free from nodules also at high current densities during the surface treatment;

the electrolyte between the surface to be coated and the anode is always constant at the correct density and at the correct temperature during every deposition steps.

Figure 8:
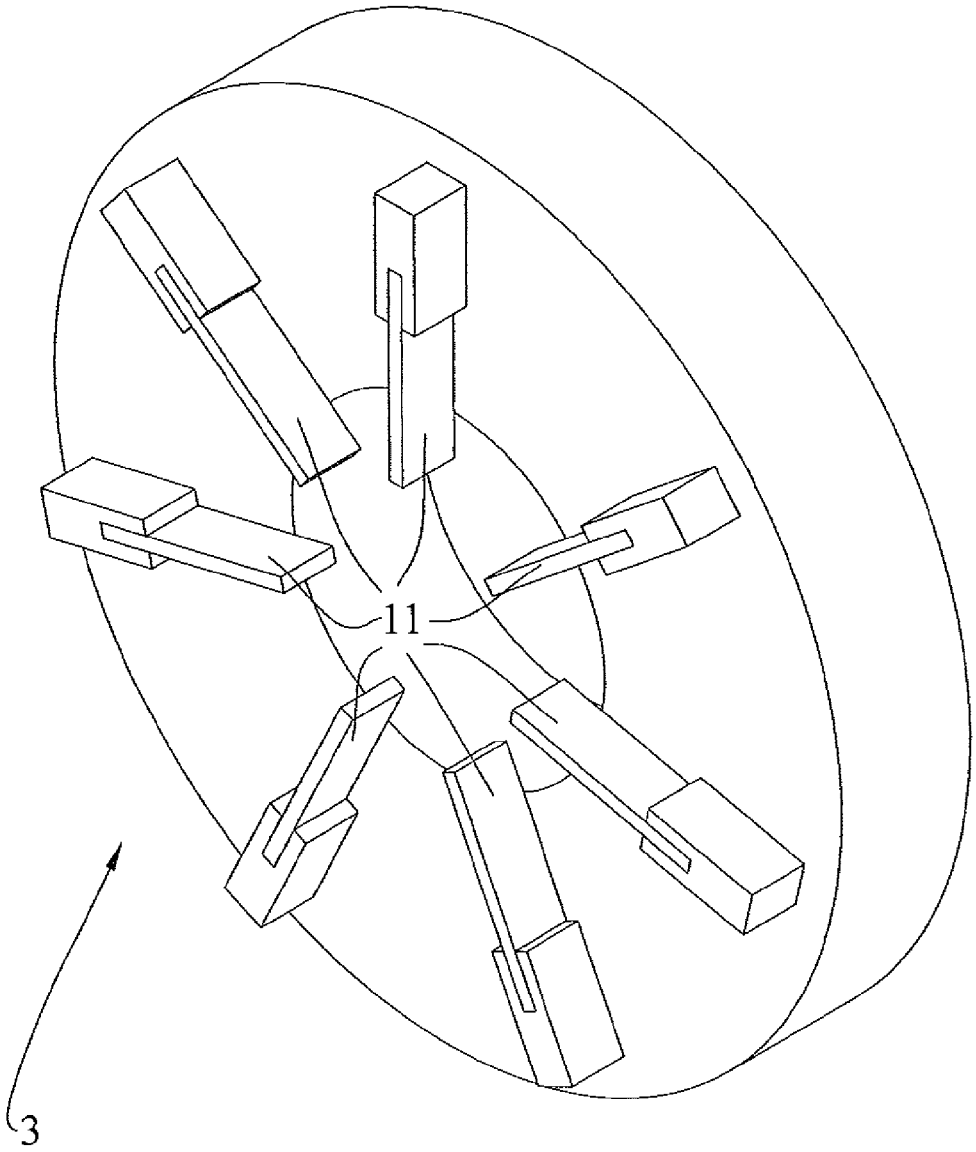
FIG. 8 shows a further configuration of the sliding contacts.

Advantageously, the distribution of contacts 11 about bar 2 may be that shown in FIG. 8, i.e. radially distributed about the bar 2 because they are supported by a ring 50 through which the bar 2 passes sliding on the contacts 11.

Multiple layers even of different materials may be advantageously deposited, in subsequent layers. Indeed the electrolytic process may be repeated several times by simply added several machining steps on the same rototranslating line.

The invention claimed is:

1. An apparatus for continuous electrolytic surface finishing of bars comprising at least one cathode, one electrolytic cell containing an electrolyte and comprising an inlet and an outlet for the bars, and at least one longitudinal anode along the route of the bars inside the electrolytic cell, and means for feeding the bars along the axis of the bars for introducing bars into the cell, characterized in that said at least one cathode consists of a plurality of sliding contacts, each of which is provided with a selectively and independently actuatable energetic source thereof.

2. The apparatus according to claim 1, characterized in that said at least one cathode is provided with a plurality of sliding contacts radially distributed about the bar because they are supported by a ring through which the bar passes sliding on the contacts.

3. The apparatus according to claim 1, characterized in that it comprises rollers with inclined axis with respect to the axis of the bars for rototranslating the bars.

4. The apparatus according to claim 1, characterized in that said electrolytic cell further comprises nozzles for introducing a fresh electrolyte in the direction of the axis of the bar at the cell.

5. The process for the continuous electrolytic surface finishing of bars comprising the independent activation of energy sources for respective sliding cathodic contacts radially distributed about a bar to be surface finished in an apparatus according to claim 1.

* * * * *